US006532636B1

(12) United States Patent
Walsh et al.

(10) Patent No.: US 6,532,636 B1
(45) Date of Patent: Mar. 18, 2003

(54) HAND-HELD TOOL FOR GUIDING AN INTEGRAL PIECE OF SHEET METAL INTO A PAIR OF SHEET METAL CONNECTORS POSITIONED END-TO-END AND ORIENTED AT AN ANGLE RELATIVE TO EACH OTHER

(75) Inventors: Timothy E. Walsh, Hicksville, NY (US); Thomas M. Howard, Lindenhurst, NY (US)

(73) Assignee: Lockfast Duct Connector LLC, Hicksville, NY (US)

( * ) Notice: Subject to any disclaimer, the term of this patent is extended or adjusted under 35 U.S.C. 154(b) by 0 days.

(21) Appl. No.: 10/012,748

(22) Filed: Dec. 7, 2001

(51) Int. Cl.[7] ..... B25B 27/14

(52) U.S. Cl. ..... 29/272; 29/270; 29/243; 29/242; 254/131.5

(58) Field of Search ..... 29/270, 272, 242, 29/243; 254/131.5, 113; 294/58, 49, 54.5, 59, 57; D08/10

(56) References Cited

U.S. PATENT DOCUMENTS 3,113,758 A * 12/1963 Knowles ..... 294/58
5,392,484 A * 2/1995 Stolzfus ..... 29/272
5,533,578 A * 7/1996 Powell ..... 294/49
5,669,650 A * 9/1997 Rutz ..... 294/58
5,810,407 A * 9/1998 Melendez et al. ..... 294/49

* cited by examiner

*Primary Examiner*—Lee Wilson
(74) *Attorney, Agent, or Firm*—Charles E. Baxley

(57) ABSTRACT

A hand-held tool for guiding an integral piece of sheet metal into a pair of sheet metal connectors positioned end-to-end and oriented at an angle relative to each other so as to form a corner. Each sheet metal connector has a pair of spaced-apart walls that define a channel therebetween for receiving the integral piece of sheet metal, and a flange that extends outwardly from one wall thereof. The tool includes a handle and a blade that extends axially from the handle. The blade is shaped for inserting into the channel of each of the pair of sheet metal connectors simultaneously, at the corner, and defining with the other wall of each of the pair of sheet metal connectors a converging pathway for guiding the integral piece of sheet metal into the channel of each of the pair of sheet metal connectors simultaneously, at the corner.

16 Claims, 4 Drawing Sheets

HAND-HELD TOOL FOR GUIDING AN INTEGRAL PIECE OF SHEET METAL INTO A PAIR OF SHEET METAL CONNECTORS POSITIONED END-TO-END AND ORIENTED AT AN ANGLE RELATIVE TO EACH OTHER

BACKGROUND OF THE INVENTION

1. Field of the Invention

The present invention relates to a hand-held tool for guiding sheet metal. More particularly, the present invention relates to a hand-held tool for guiding an integral piece of sheet metal into a pair of sheet metal connectors positioned end-to-end and oriented at an angle relative to each other.

2. Description of the Prior Art

Heretofore it has been conventional to employ duct connectors, which used screws, bolts, clips, drives, and other external hardware to connect ducts end-to-end. The prior art connectors also required use of welding and metal working tools of various kinds.

These prior art techniques made installation of rectangular air conditioning ducts slow and laborious. Furthermore, in service, these connectors permitted leakage of conditioned air under pressure in air conditioning systems.

Thus, there existed a need for a duct connector that makes installation of rectangular air conditioning ducts fast and not laborious and which does not permit leakage of conditioned air under pressure in air conditioning systems.

This need has been met by a sheet metal connector for joining two pieces of sheet metal together end-to-end that we teach in a copending application. A first wall and a second wall define a first channel therebetween, into which a ledge extends, and which lockingly receives one piece of sheet metal, by virtue of at least one reverse button lock on a raw free end of the one piece of sheet metal snapingly engaging against the ledge. A third wall terminates in a free edge that is folded onto itself, and together with the first wall, defines a second channel therebetween that lockingly receives the other piece of sheet metal, by virtue of at least one reverse button lock on a raw free end of the other piece of sheet metal snapingly engaging against the folded free edge of the third wall.

When a pair of these sheet metal connectors are positioned end-to-end and oriented at an angle relative to each other so as to form a corner and are both intended to lockingly receive an integral piece of sheet metal, then there exists a need for a hand-held tool that will guide the integral piece of sheet metal into the first channels of both of the sheet metal connectors simultaneously, at the corner.

Numerous innovations for hand-held guiding tools have been provided in the prior art. Even though these innovations may be suitable for the specific individual purposes to which they address, however, they differ from the present invention in that they do not teach a hand-held tool for guiding an integral piece of sheet metal into a pair of sheet metal connectors positioned end-to-end and oriented at an angle relative to each other, and would therefore be not suitable for the purposes of the present invention as heretofore described.

SUMMARY OF THE INVENTION

ACCORDINGLY, AN OBJECT of the present invention is to provide a hand-held tool for guiding an integral piece of sheet metal into a pair of sheet metal connectors positioned end-to-end and oriented at an angle relative to each other that avoids the disadvantages of the prior art.

ANOTHER OBJECT of the present invention is to provide a hand-held tool for guiding an integral piece of sheet metal into a pair of sheet metal connectors positioned end-to-end and oriented at an angle relative to each other that is simple to use.

BRIEFLY STATED, STILL ANOTHER OBJECT of the present invention is to provide a hand-held tool for guiding an integral piece of sheet metal into a pair of sheet metal connectors positioned end-to-end and oriented at an angle relative to each other so as to form a corner. Each sheet metal connector has a pair of spaced-apart walls that define a channel therebetween for receiving the integral piece of sheet metal and a flange that extends outwardly from one wall thereof. The tool includes a handle and a blade that extends axially from the handle. The blade is shaped for inserting into the channel of each of the pair of sheet metal connectors simultaneously, at the corner, and defining with the other wall of each of the pair of sheet metal connectors a converging pathway for guiding the integral piece of sheet metal into the channel of each of the pair of sheet metal connectors simultaneously, at the corner.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
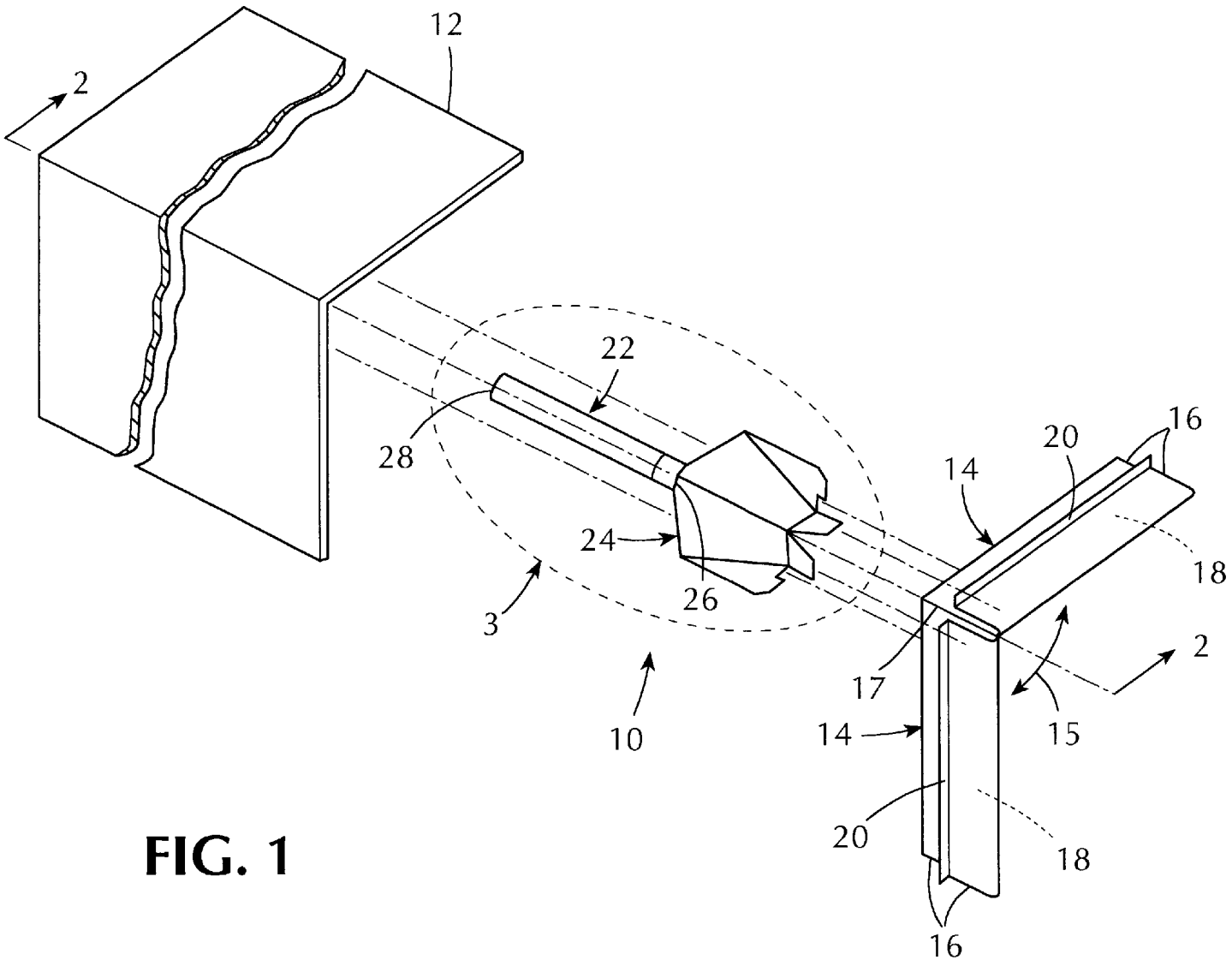
FIG. 1 is an exploded diagrammatic perspective view of the hand-held tool for guiding an integral piece of sheet metal into a pair of sheet metal connectors positioned end-to-end and oriented at an angle relative to each other.

10 hand-held tool of present invention for guiding integral piece of sheet metal 12 into pair of sheet metal connectors 14 positioned end-to-end and oriented at angle 15 relative to each other so as to form a corner 17

12 integral piece of sheet metal

14 pair of sheet metal connectors positioned end-to-end and oriented at angle 15 relative to each other

15 angle pair of sheet metal connectors 14 are oriented relative to each other

16 pair of spaced-apart walls of each sheet metal connector of pair of sheet meal connectors 14
17 corner formed by pair of sheet metal connectors 14
18 channel defined by pair of spaced-apart walls 16 of each sheet metal connector of pair of sheet meal connectors 14 for receiving integral piece of sheet metal 12
20 flange of each sheet metal connector of pair of sheet meal connectors 14
22 handle for fitting in palm of hand (not shown)
24 blade for inserting into channel 18 of each sheet metal connector of pair of sheet metal connectors 14 simultaneously, at corner 17
26 proximal end of handle 22
28 distal end of handle 22
30 converging pathway for guiding integral piece of sheet metal 12 into channel 18 of each sheet metal connector of pair of sheet metal connectors 14 simultaneously, at corner 17
32 body of blade 24
34 head of blade 24
36 wings of blade 24
38 first portion of body 32 of blade 24
40 second portion of body 32 of blade 24
42 innermost edge of first portion 38 of body 32 of blade 24
44 innermost edge of second portion 40 of body 32 of blade 24
46 longitudinal axis of body 32 of blade 24
48 proximal end of longitudinal axis 46 of body 32 of blade 24
50 angle first portion 38 of body 32 of blade 24 and second portion 40 of body 32 of blade 24 are downwardly oriented relative to each other
52 outermost edge of first portion 38 of body 32 of blade 24
54 forwardmost edge of first portion 38 of body 32 of blade 24
56 outermost edge of second portion 40 of body 32 of blade 24
58 forwardmost edge of second portion 40 of body 32 of blade 24
60 first portion of head 34 of blade 24
62 second portion of head 34 of blade 24
64 rearwardmost edge of first portion 60 of head 34 of blade 24
66 forwardmost edge of first portion 60 of head 34 of blade 24
68 rearwardmost edge of second portion 62 of head 34 of blade 24
70 forwardmost edge of second portion 62 of head 34 of blade 24
72 first wing of wings 36 of blade 24
74 second wing of wings 36 of blade 24
76 lowermost edge of first wing 72 of wings 36 of blade 24
78 lowermost edge of second wing 74 of wings 36 of blade 24
80 forwardmost edge of first wing 72 of wings 36 of blade 24
82 forwardmost edge of second wing 74 of wings 36 of blade 24
84 notch in forwardmost edge 80 of first wing 72 of wings 36 of blade 24 for capturing flange 20 of one sheet metal connector of pair of sheet metal connectors 14 therein, and in so doing, stops travel of first portion 60 of head 34 of blade 24 in channel 18 of one sheet metal connector of pair of sheet metal connectors 14
86 notch in forwardmost edge 82 of second wing 74 of wings 36 of blade 24 for capturing flange 20 of other sheet metal connector of pair of sheet metal connectors 14 therein, and in so doing, stops travel of second portion 62 of head 34 of blade 24 in channel 18 of other sheet metal connector of the pair of sheet metal connectors 14

DETAILED DESCRIPTION OF THE PREFERRED EMBODIMENT

Figure 2:
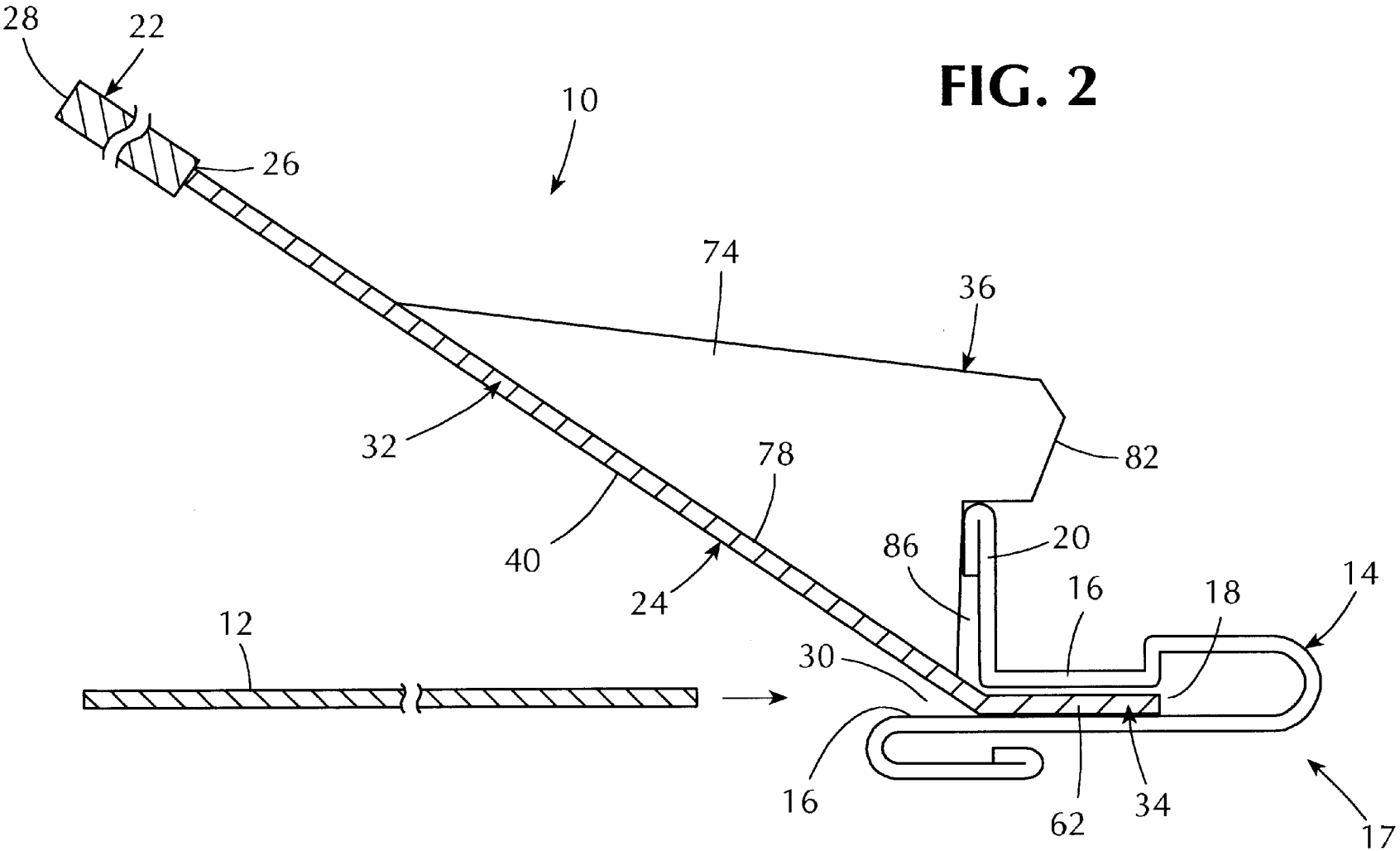
FIG. 2 is an enlarged diagrammatic cross sectional view taken on LINE 2—2 in FIG. 1 illustrating the converging pathway defined by the blade of the present invention shown in FIG. 1 and the other wall of the pair of spaced-apart walls of one sheet metal connector of the pair of sheet metal connectors shown in FIG. 1.

Referring now to the figures, in which like numerals indicate like parts, and particularly to FIGS. 1 and 2, which are, respectively, an exploded diagrammatic perspective view of the hand-held tool of the present invention guiding an integral piece of sheet metal into a pair of sheet metal connectors positioned end-to-end and oriented at an angle relative to each other, and an enlarged diagrammatic cross sectional view taken on LINE 2—2 in FIG. 1 illustrating the converging pathway defined by the blade of the present invention shown in FIG. 1 and the other wall of the pair of spaced-apart walls of one sheet metal connector of the pair of sheet metal connectors shown in FIG. 1, the hand-held tool of present invention is shown generally at 10 for guiding an integral piece of sheet metal 12 into a pair of sheet metal connectors 14 positioned end-to-end and oriented at an angle 15 relative to each other so as to form a corner 17. Each of the pair of sheet metal connectors 14 has a pair of spaced-apart walls 16 that define a channel 18 therebetween that receives the integral piece of sheet metal 12, and a flange 20 that extends outwardly from one wall of the pair of spaced-apart walls 16 thereof.

The hand-held tool 10 comprises a handle 22 and a blade 24 that extends axially from the handle 22. The handle 22 is elongated, fits in the palm of a hand (not shown), and has a proximal end 26 and a distal end 28 that is free.

As shown in FIG. 2, the blade 24 is shaped to insert into the channel 18 of each sheet metal connector of the pair of sheet metal connectors 14 simultaneously, at the corner 17, and defines with the other wall of the pair of spaced-apart walls 16 of each sheet metal connector of the pair of sheet metal connectors 14 a converging pathway 30 for guiding the integral piece of sheet metal 12 into the channel 18 of each sheet metal connector of the pair of sheet metal connectors 14 simultaneously, at the corner 17.

Figure 3:
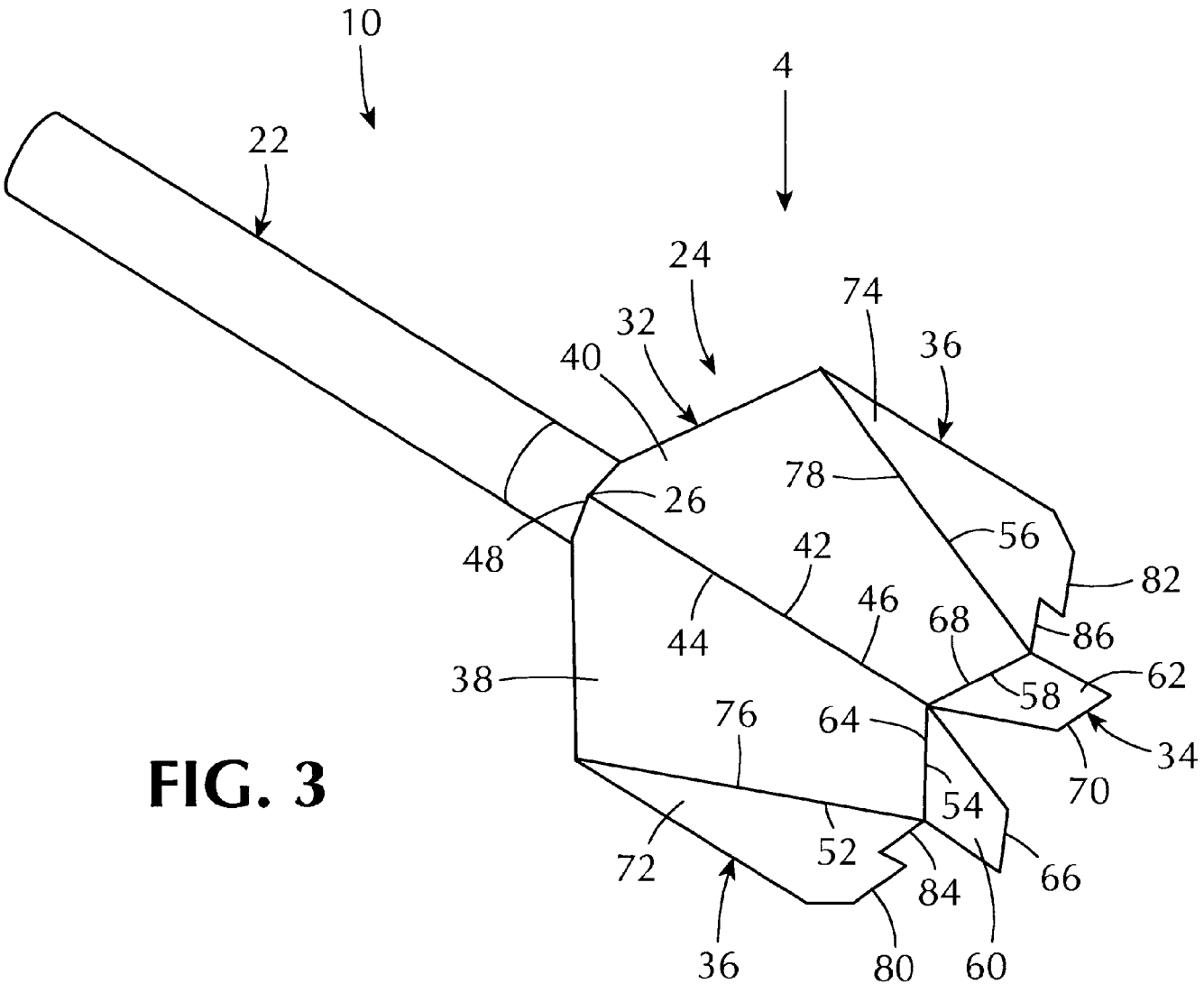
FIG. 3 is an enlarged diagrammatic perspective view of the area generally enclosed by the dotted curve identified by ARROW 3 in FIG. 1 of the hand-held tool of the present invention shown in FIG. 1.
Figure 4:
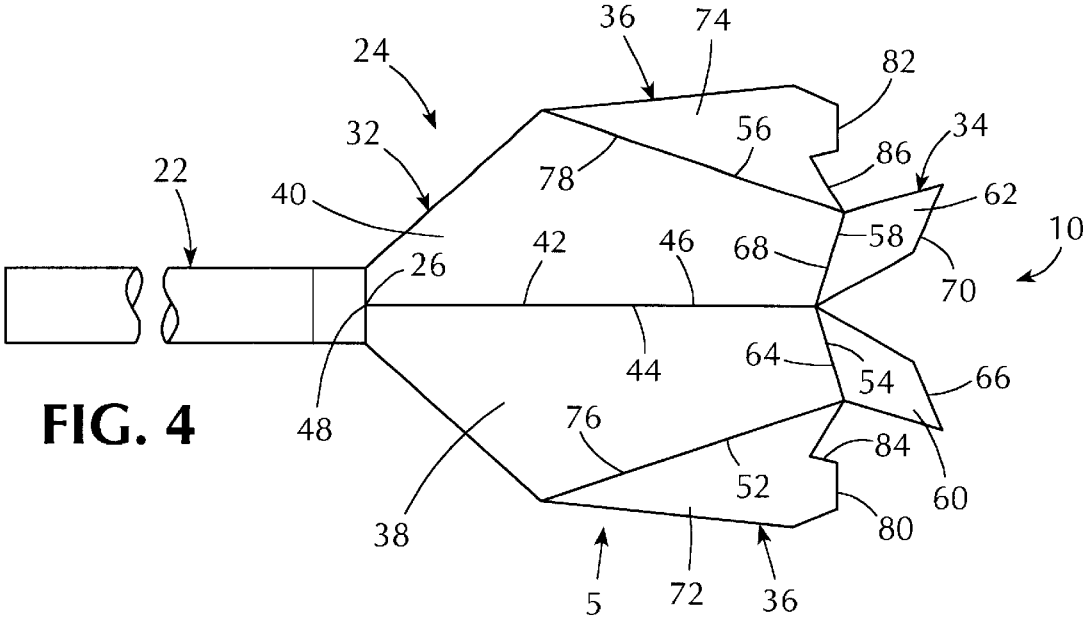
FIG. 4 is a diagrammatic top plan view taken generally in the direction of ARROW 4 in FIG. 3.
Figure 5:
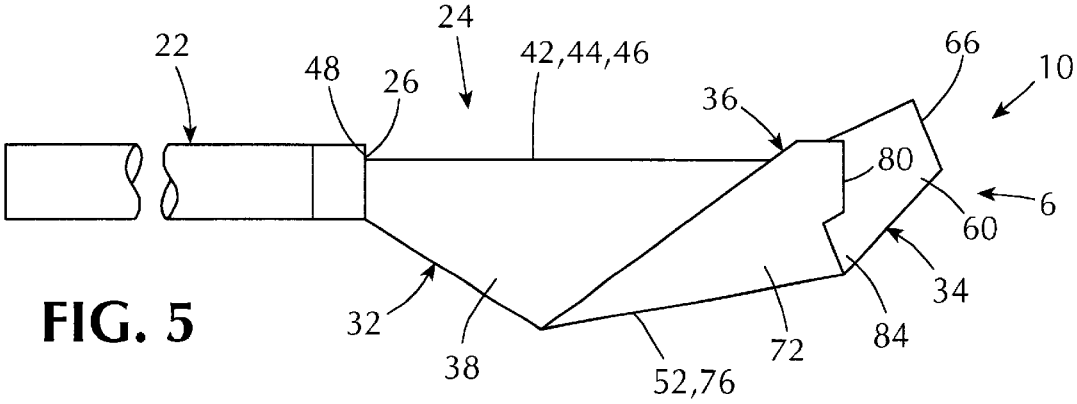
FIG. 5 is a diagrammatic side elevational view taken generally in the direction of ARROW 5 in FIG. 4.
Figure 6:
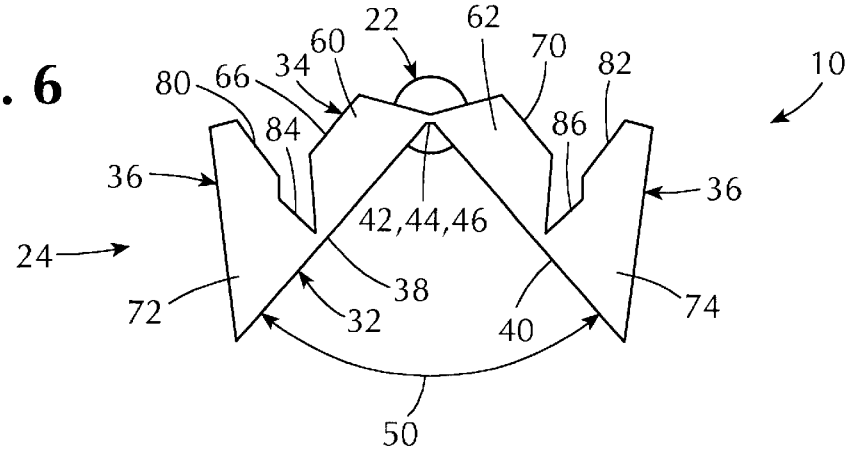
FIG. 6 is an enlarged diagrammatic front elevational view taken generally in the direction of ARROW 6 in FIG. 5.

The specific configuration of the blade 24 can best be seen in FIGS. 3–6, which are, respectively, an enlarged diagrammatic perspective view of the area generally enclosed by the dotted curve identified by ARROW 3 in FIG. 1 of the hand-held tool of the present invention shown in FIG. 1, a diagrammatic top plan view taken generally in the direction of ARROW 4 in FIG. 3, a diagrammatic side elevational view taken generally in the direction of ARROW 5 in FIG. 4, and an enlarged diagrammatic front elevational view taken generally in the direction of ARROW 6 in FIG. 5, and as such, will be discussed with reference thereto.

The blade 24 has a body 32, a head 34, and wings 36. The body 32 of the blade 24 extends forwardly and axially from the handle 22.

The head 34 of the blade 24 extends forwardly and upwardly from the body 32 of the blade 24 and is inserted into the channel 18 of each sheet metal connector of the pair of sheet metal connectors 14 simultaneously, at the corner 17, and in so doing, the body 32 of the blade 24 defines with the other wall of the pair of spaced-apart walls 16 of each sheet metal connector of the pair of sheet metal connectors 14 the converging pathway 30 for guiding the integral piece of sheet metal 12 into the channel 18 of each sheet metal connector of the pair of sheet metal connectors 14 simultaneously, at the corner 17 (see FIG. 2).

The wings 36 of the blade 24 extend upwardly from the body 32 of the blade 24 and are for engaging against the flange 20 of each sheet metal connector of the pair of sheet metal connectors 14 simultaneously, at the corner 17 (see FIG. 2).

The body 32 of the blade 24 comprises a first portion 38 and a second portion 40. The first portion 38 of the body 32 of the blade 24 is flat and has an innermost edge 42, and the second portion 40 of the body 32 of the blade 24 is flat, has an innermost edge 44, and is a mirror image of the first portion 38 of the body 32 of the blade 24. The innermost edge 42 of the first portion 38 of the body 32 of the blade 24 is coincident with the innermost edge 44 of the second portion 40 of the body 32 of the blade 24, and forms therewith, a longitudinal axis 46 of the body 32 of the blade 24 that has a proximal end 48. The first portion 38 of the body 32 of the blade 24 and the second portion 40 of the body 32 of the blade 24 are downwardly oriented at an angle 50 relative to each other, about the longitudinal axis 46 of the body 32 of the blade 24. The angle 50 of the body 32 of the blade 24 is equal to the angle 15 that the pair of sheet metal connectors 14 are oriented relative to each other.

The longitudinal axis 46 of the body 32 of the blade 24 extends collinearly from the handle 22, with the proximal end 26 of the handle 22 being coincident with the proximal end 48 of the longitudinal axis 46 of the body 32 of the blade 24.

The first portion 38 of the body 32 of the blade 24 further has an outermost edge 52 and a forwardmost edge 54 that extends outwardly from one side of the longitudinal axis 46 of the body 32 of the blade 24. The second portion 40 of the body 32 of the blade 24 further has an outermost edge 56 and a forwardmost edge 58 that extends outwardly from the other side of the longitudinal axis 46 of the body 32 of the blade 24.

The head 34 of the blade 24 comprises a first portion 60 and a second portion 62. The first portion 60 of the head 34 of the blade 24 is flat and tapered to facilitate insertion into the channel 18 of the one sheet metal connector of the pair of sheet metal connectors 14, at the corner 17. The second portion 62 of the head 34 of the blade 24 is flat, tapered to facilitate insertion into the channel 18 of the other sheet metal connector of the pair of sheet metal connectors 14, at the corner 17, is a mirror image of the first portion 60 of the head 34 of the blade 24, and is independent of the first portion 60 of the head 34 of the blade 24.

The first portion 60 of the head 34 of the blade 24 extends forwardly and upwardly from the first portion 38 of the body 32 of the blade 24, at an obtuse angle, and the second portion 62 of the head 34 of the blade 24 extends forwardly and upwardly from the second portion 40 of the body 32 of the blade 24, at the obtuse angle, and in so doing, provide the converging pathway 30 by virtue of the first portion 38 of the body 32 of the blade 24 being angled away from the other wall of the pair of spaced-apart walls 16 of the one sheet metal connector of the pair of sheet metal connectors 14 so as to diverge therefrom when the first portion 60 of the head 34 of the blade 24 is inserted into the channel 18 of the one sheet metal connector of the pair of sheet metal connectors 14, at the corner 17, and the second portion 40 of the body 32 of the blade 24 is angled away from the other wall of the pair of spaced-apart walls 16 of the other sheet metal connector of the pair of sheet metal connectors 14 so as to diverge therefrom when the second portion 62 of the head 34 of the blade 24 is inserted into the channel 18 of the other sheet metal connector of the pair of sheet metal connectors 14, at the corner 17 (see FIG. 2).

The first portion 60 of the head 34 of the blade 24 has a rearwardmost edge 64 that is coincident with the forwardmost edge 54 of the first portion 38 of the body 32 of the blade 24 and a forwardmost edge 66 that is free and leads the insertion into the channel 18 of the one sheet metal connector of the pair of sheet metal connectors 14, at the corner 17. The second portion 62 of the head 34 of the blade 24 has a rearwardmost edge 68 that is coincident with the forwardmost edge 58 of the second portion 40 of the body 32 of the blade 24 and a forwardmost edge 70 that is free and leads the insertion into the channel 18 of the other sheet metal connector of the pair of sheet metal connectors 14, at the corner 17.

The wings 36 of the blade 24 comprise a first wing 72 and a second wing 74 that is independent of the first wing 72 of the wings 36 of the blade 24 and is a mirror image of the first wing 72 of the wings 36 of the blade 24. The first wing 72 of the wings 36 of the blade 24 extends perpendicularly upwardly from the first portion 38 of the body 32 of the blade 24, is flat, triangular-shaped, and has a lowermost edge 76 that is coincident with the outermost edge 52 of the first portion 38 of the body 32 of the blade 24. The second wing 74 of the wings 36 of the blade 24 extends perpendicularly upwardly from the second portion 40 of the body 32 of the blade 24, is flat, triangular-shaped, and has a lowermost edge 78 that is coincident with the outermost edge 56 of the second portion 40 of the body 32 of the blade 24.

The first wing 72 of the wings 36 of the blade 24 further has a forwardmost edge 80 that is free and the second wing 74 of the wings 36 of the blade 24 further has a forwardmost edge 82 that is free. The forwardmost edge 80 of the first wing 72 of the wings 36 of the blade 24 has a notch 84 that extends therein and partially upwardly from the lowermost edge 76 of the first wing 72 of the wings 36 of the blade 24 and which captures the flange 20 of the one sheet metal connector of the pair of sheet metal connectors 14 therein, and in so doing, stops travel of the first portion 60 of the head 34 of the blade 24 in the channel 18 of the one sheet metal connector of the pair of sheet metal connectors 14, at the corner 17. The forwardmost edge 82 of the second wing 74 of the wings 36 of the blade 24 has a notch 86 that extends therein and partially upwardly from the lowermost edge 78 of the second wing 74 of the wings 36 of the blade 24 and captures the flange 20 of the other sheet metal connector of the pair of sheet metal connectors 14 therein, and in so doing, stops travel of the second portion 62 of the head 34 of the blade 24 in the channel 18 of the other sheet metal connector of the pair of sheet metal connectors 14, at the corner 17 (see FIG. 2).

It will be understood that each of the elements described above, or two or more together, may also find a useful application in other types of constructions differing from the types described above.

While the invention has been illustrated and described as embodied in a hand-held tool for guiding an integral piece of sheet metal into a pair of sheet metal connectors positioned end-to-end and oriented at an angle relative to each other, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand-held tool for guiding an integral piece of sheet metal into a pair of sheet metal connectors positioned end-to-end and oriented at an angle relative to each other so as to form a corner, wherein each sheet metal connector has a pair of spaced-apart walls defining a channel therebetween for receiving the integral piece of sheet metal and a flange extending outwardly from one wall thereof, said tool comprising:

a) a handle; and b) a blade;

wherein said blade extends axially from said handle;

wherein said blade is shaped for inserting into the channel of each sheet metal connector of the pair of sheet metal connectors simultaneously, at the corner, and defining with the other wall of the pair of spaced-apart walls of each sheet metal connector of the pair of sheet metal connectors a converging pathway for guiding the integral piece of sheet metal into the channel of each sheet metal connector of the pair of sheet metal connectors simultaneously, at the corner;

wherein said blade has a body;

wherein said body of said blade extends forwardly from said handle;

wherein said body of said blade extends axially from said handle;

wherein said blade comprises a head;

wherein said head of said blade extends forwardly from said body of said blade;

wherein said head of said blade extends upwardly from said body of said blade;

wherein said head of said blade is for inserting into the channel of each sheet metal connector of the pair of sheet metal connectors simultaneously, at the corner, and in so doing, said body of said blade defines with the other wall of the pair of spaced-apart walls of each sheet metal connector of the pair of sheet metal connectors the converging pathway for guiding the integral piece of sheet metal into the channel of each sheet metal connector of the pair of sheet metal connectors simultaneously, at the corner;

wherein said body of said blade comprises a first portion;

wherein said first portion of said body of said blade is flat;

wherein said body of said blade comprises a second portion;

wherein said second portion of said body of said blade is flat;

wherein said first portion of said body of said blade and said second portion of said body of said blade are mirror images of each other;

wherein said first portion of said body of said blade has an innermost edge;

wherein said second portion of said body of said blade has an innermost edge;

wherein said innermost edge of said first portion of said body of said blade is coincident with said innermost edge of said second portion of said body of said blade, and forms therewith, a longitudinal axis of said body of said blade;

wherein said longitudinal axis of said body of said blade has a proximal end; and wherein said first portion of said body of said blade and said second portion of said body of said blade are oriented downwardly at an angle to each other, about said longitudinal axis of said body of said blade, that is equal to the angle the pair of sheet metal connectors are oriented relative to each other.

2. The tool as defined in claim 1, wherein said handle is elongated;

wherein said handle is for fitting in the palm of a hand;

wherein said handle has a distal end; and wherein said distal end of said handle is free.

3. The tool as defined in claim 1, wherein said blade comprises wings;

wherein said wings of said blade extend upwardly from said body of said blade; and wherein said wings of said blade are for engaging against the flange of each sheet metal connector of the pair of sheet metal connectors simultaneously, at the corner.

4. The tool as defined in claim 1, wherein said longitudinal axis of said body of said blade extends collinearly from said handle;

wherein said handle has a proximal end; and wherein said proximal end of said handle is coincident with said proximal end of said longitudinal axis of said body of said blade.

5. The tool as defined in claim 1, wherein said first portion of said body of said blade has a forwardmost edge;

wherein said forwardmost edge of said first portion of said body of said blade extends outwardly from one side of said longitudinal axis of said body of said blade;

wherein said second portion of said body of said blade has a forwardmost edge; and wherein said forwardmost edge of said second portion of said body of said blade extends outwardly from the other side of said longitudinal axis of said body of said blade.

6. The tool as defined in claim 5, wherein said head of said blade comprises a first portion;

wherein said first portion of said head of said blade is flat;

wherein said head of said blade comprises a second portion;

wherein said second portion of said head of said blade is flat;

wherein said first portion of said head of said blade and said second portion of said head of said blade are mirror images of each other;

wherein said first portion of said head of said blade has a rearwardmost edge;

wherein said second portion of said head of said blade has a rearwardmost edge;

wherein said rearwardmost edge of said first portion of said head of said blade is coincident with said forwardmost edge of said first portion of said body of said blade; and wherein said rearwardmost edge of said second portion of said head of said blade is coincident with said forwardmost edge of said second portion of said body of said blade.

7. The tool as defined in claim 6, wherein said first portion of said head of said blade extends forwardly and upwardly from said first portion of said body of said blade at an obtuse angle and said second portion of said head of said blade extends forwardly and upwardly from said second portion of said body of said blade at said obtuse angle, and in so doing, provide said converging pathway by virtue of said first portion of said body of said blade being angled away from the other wall of the pair of spaced-apart walls of one sheet metal connector of the pair of connectors so as to diverge therefrom when said first portion of said head of said blade is inserted into the channel of the one sheet metal connector of the pair of connectors, at the corner, and said second portion of said body of said blade is angled away from the other wall of the pair of spaced-apart walls of the other sheet metal connector of the pair of connectors so as to diverge therefrom when said second portion of said head of said blade is inserted into the channel of the other sheet metal connector of the pair of connectors, at the corner.

8. The tool as defined in claim 6, wherein said first portion of said head of said blade is independent of said second portion of said head of said blade.

9. The tool as defined in claim 6, wherein said first portion of said head of said blade is tapered for facilitating insertion into the channel of one sheet metal connector of the pair of sheet metal connectors, at the corner; and wherein said second portion of said head is tapered for facilitating insertion into the channel of the other sheet metal connector of the pair of sheet metal connectors, at the corner.

10. The tool as defined in claim 6, wherein said first portion of said head of said blade has a forwardmost edge;

wherein said forwardmost edge of said first portion of said head of said blade is free;

wherein said forwardmost edge of said first portion of said head of said blade is for leading the insertion into the channel of one sheet metal connector of the pair of sheet metal connectors, at the corner;

wherein said second portion of said head of said blade has a forwardmost edge;

wherein said forwardmost edge of said second portion of said head of said blade is free; and wherein said forwardmost edge of said second portion of said head of said blade is for leading the insertion into the channel of the other sheet metal connector of the pair of sheet metal connectors, at the corner.

11. The tool as defined in claim 6, wherein said wings of said blade comprise a first wing;

wherein said first wing of said blade is flat;

wherein said wings of said blade comprise a second wing;

wherein said second wing of said blade is flat;

wherein said first wing of said blade and said second wing of said blade are mirror images of each other;

wherein said first wing of said blade has a lowermost edge;

wherein said second wing of said blade has a lowermost edge;

wherein said first portion of said body of said blade has an outermost edge;

wherein said lowermost edge of said first wing of said blade is coincident with said outermost edge of said first portion of said body of said blade;

wherein said second portion of said body of said blade has an outermost edge; and wherein said lowermost edge of said second wing of said blade is coincident with said outermost edge of said second portion of said body of said blade.

12. The tool as defined in claim 11, wherein said first wing of said blade extends perpendicularly upwardly from said first portion of said body of said blade; and wherein said second wing of said blade extends perpendicularly upwardly from said second portion of said body of said blade.

13. The tool as defined in claim 11, wherein said first wing of said blade is independent of said second wing of said blade.

14. The tool as defined in claim 11, wherein said first wing of said blade is triangular-shaped; and wherein said second wing of said blade is triangular-shaped.

15. The tool as defined in claim 11, wherein said first wing of said blade has a forwardmost edge;

wherein said forwardmost edge of said first wing of said blade is free;

wherein said second wing of said blade has a forwardmost edge; and wherein said forwardmost edge of said second wing of said blade is free.

16. The tool as defined in claim 15, wherein said forwardmost edge of said first wing of said blade has a notch;

wherein said notch in said forwardmost edge of said first wing of said blade extends therein and partially upwardly from said lowermost edge of said first wing of said blade;

wherein said notch in said forwardmost edge of said first wing of said blade is for capturing the flange of one sheet metal connector of the pair of sheet metal connectors therein, at the corner, and in so doing, stops travel of said first portion of said head of said blade in the channel of the one sheet metal connector of the pair of sheet metal connectors;

wherein said forwardmost edge of said second wing of said blade has a notch;

wherein said notch in said forwardmost edge of said second wing of said blade extends therein and partially upwardly from said lowermost edge of said second wing of said blade; and wherein said notch in said forwardmost edge of said second wing of said blade is for capturing the flange of the other sheet metal connector of the pair of sheet metal connectors therein, at the corner, and in so doing, stops travel of said second portion of said head of said blade in the channel of the other sheet metal connector of the pair of sheet metal connectors.

* * * * *